US007037019B2

(12) United States Patent
Miyamoto et al.

(10) Patent No.: US 7,037,019 B2
(45) Date of Patent: May 2, 2006

(54) INK-STORING MEMBER FOR WRITING INSTRUMENT

(75) Inventors: Masaru Miyamoto, Yokohama (JP); Kenji Sato, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 162 days.

(21) Appl. No.: 10/719,022

(22) Filed: Nov. 24, 2003

(65) Prior Publication Data

US 2004/0265041 A1 Dec. 30, 2004

(30) Foreign Application Priority Data

Nov. 22, 2002 (JP) ..... 2002-339547

(51) Int. Cl.
*B43K 5/02* (2006.01)

(52) U.S. Cl. ..... 401/222; 401/141; 401/142; 401/192

(58) Field of Classification Search ..... 401/141, 401/142, 192, 195, 222; 138/137, 140, 141, 138/DIG. 3
See application file for complete search history.

(56) References Cited

U.S. PATENT DOCUMENTS 5,803,130 A * 9/1998 Robben et al. ..... 138/137
5,958,532 A * 9/1999 Krause et al. ..... 138/141
6,200,053 B1 * 3/2001 Asami et al. ..... 401/142
6,742,952 B1 * 6/2004 Chen et al. ..... 401/222

FOREIGN PATENT DOCUMENTS

| | | | |
|---|---|---|---|
| JP | 5-84236 | B2 | 12/1993 |
| JP | 08-133346 | A | 5/1996 |
| JP | 9-141180 | A | 6/1997 |
| JP | 2002-011989 | A | 1/2002 |
| JP | 2002-307890 | A | 10/2002 |

* cited by examiner

*Primary Examiner*—Tuan Nguyen
(74) *Attorney, Agent, or Firm*—Buchanan Ingersoll PC

(57) ABSTRACT

An ink-storing member for a writing instrument which can inhibit deterioration in the ink caused by permeation of oxygen and nitrogen contained in air, inhibit leaking of the ink and generation of bubbles, enhance discharge stability of the ink, improve fragrance retention of a perfume-containing ink, prevent inferior writing brought about by reduction in an internal pressure of an ink-storing vessel in a pressure type writing instrument and prevent deterioration in the ink due to vaporization of moisture of a water-based ink and deterioration in the ink caused y moisture absorption in an oil-based ink. Such ink-storing member includes, for example, an ink-storing member for a writing instrument which is constituted of a multilayer structure having an organic high molecular compound layer constituted of an organic high molecular compound an inorganic compound layer constituted of an inorganic compound.

6 Claims, 3 Drawing Sheets

INK-STORING MEMBER FOR WRITING INSTRUMENT

TECHNICAL FIELD

The present invention relates to an ink-storing member for a writing instrument such as an ink-storing vessel and an ink-storing tube for a pressurized or non-pressurized writing instrument which stores an ink for a writing instrument such as a water-based or oil-based liquid ink and a gel ink.

BACKGROUND ART

A wide variety of writing instruments has so far been known, and in general, the role of an ink-storing vessel of a free ink type instrument having a collector structure and a sliver type instrument and an ink-storing tube (an ink tube and a refill) of a ballpoint pen has had a principal object of storing an ink for a writing instrument such as a water-based or oil-based liquid ink and a gel ink and preventing a solvent constituting the ink from volatilizing.

Usually, these ink-storing vessel and ink-storing tube for a writing instrument are constituted of organic high molecular compounds (synthetic resins and the like) such as polypropylene from the viewpoints of the chemical stability, the solvent resistance, the economical efficiency and the productivity.

However, according to the researches and the knowledges of the present inventors, in observing with the passage of time, air, especially oxygen penetrates into an ink-storing vessel or an ink-storing tube, whereby the ink is oxidized, and accelerated are the problems of deterioration in the ink itself such as thickening of the ink and reduction in a density of the colorant, reduction in the writing property due to solidification in the ink caused by generation of bubbles and due to clogging in the ink-feeding passage and leaking of the ink due to a rise in the internal pressure, and involved therein is the problem of reducing a performance and a quality of the writing instrument and shortening the life thereof.

In the case where an ink for a writing instrument is a water-based ink, water, which is a principal solvent for the ink, vaporizes and penetrates through an ink-storing member, which results in losing the amount, to thereby bring about deterioration in the ink such as solidification in the ink, coagulation of the colorant and a rise in the viscosity, and involved therein are the problems of reduction in the quality of the writing instrument such as reduction in the writing property and a fall in the writing distance and shortening the life.

Also, in the case where an ink for a writing instrument is an oil-based ink, steam (humidity) present in the air penetrates through an ink-storing member and gets into the ink, whereby deterioration in the ink such as a rise in the viscosity caused by deposition of the resin and the colorant is caused, and the problem of reducing the writing quality and shortening the life is involved therein.

Further, when polypropylene, which is inexpensive and excellent in moldability and transparency, is used for an ink-storing member in a pressure type ballpoint pen, involved therein is the problem that a pressurized gas such as nitrogen gas present in the ink-storing vessel or the ink-storing tube penetrates to the outside of the vessel or the tube to cause reduction in an internal pressure of the vessel or the tube, whereby inferior writing is brought about.

On the other hand, known as a conventional ink-storing member for a writing instrument are, for example, a ballpoint pen refill in which a ballpoint pen tip rotatably holding a ball is mounted directly or via a tip holder at a point of a resin-made ink-storing tube directly filled with an ink for a ballpoint pen, wherein the periphery of the ink-storing tube described above is covered with a metal member such as stainless steel and bronze in order to prevent the ink from leaking from the interfitting parts of the ink-storing tube and the ballpoint pen tip, the tip holder or the plug and obtain a high grade appearance (Japanese Patent Application Laid-Open No. 11989/2002), and a resin-molded vessel for storing an ink for a writing instrument characterized by comprising a multilayer structure in which two or more resin layers are formed and at least one layer of the resin layers is formed with an ethylene-vinyl alcohol copolymer resin (EVOH) in order to prevent volatilization of a solvent and/or vaporization of moisture contained in the ink for a writing instrument (Japanese Patent Application Laid-Open No. 307890/2002).

On the other hand, in respect to a method for preventing discoloration in a writing instrument, known as a packaging method for an antibacterial agent-containing writing instrument is, for example, a packaging method for antibacterial agent-containing stationeries which can prevent the stationeries from being discolored by allowing a deoxidizing agent to be present in the packaging material to inhibit the stationeries from being brought into contact with oxygen and moisture present in the air to the utmost (Japanese Patent Application Laid-Open No. 133346/1996).

However, in the ballpoint pen refill described in Japanese Patent Application Laid-Open No. 11989/2002, the periphery of the ink-storing tube is merely covered with a metal member, and therefore the refill is inferior in visibility for the ink contained therein and provides the problem that it is difficult to observe the ink remaining amount. Further, the problem that a sticking work of the resin and the metal member is complicated is brought about.

Also, the resin-molded vessel for storing an ink for a writing instrument having a multilayer structure described in Japanese Patent Application Laid-Open No. 307890/2002 has a film-like EVOH layer of 10 to 150 μm thick, but it has the problem that it is still inferior in a gas-barrier property and a writing quality and has the problem of leaking of the ink.

Further, in the technique described in Japanese Patent Application Laid-Open No. 133346/1996, stationeries such as antibacterial agent-containing writing instruments are prevented from being discolored by oxidation when left standing for displaying in a showcase in a shop over a long period of time (from after production up to passing into the consumers), and the present invention is different from the application in an object, action and constitution (technical concept).

Further, a technique in which components such as polyphenol, vitamin C, vitamin E and others reacting with or absorbing oxygen which are antioxidants is added to an ink is also known as a method for preventing oxidation of the ink caused by air (oxygen) mixed in the ink, which is introduced thereinto in preparing and filling the ink.

In these techniques, however, the addition amounts are naturally restricted to be very small amounts, and therefore the problem that the function thereof is lost in a relatively short period is involved therein. The problems of oxidative deterioration in an ink caused by penetration of oxygen through an ink-storing member and deterioration due to vaporization or absorption of moisture caused by permeation of steam are not recognized in the techniques described above.

In light of the problems and the existing situations in the conventional techniques described above, the present invention intends to solve them, and an object thereof is to provide an ink-storing member for a writing instrument such as an ink-storing vessel or an ink-storing tube for a writing instrument which stores an ink for a writing instrument such as a water-based or oil-based liquid ink and a gel ink, wherein solved are prevention of deterioration in the ink caused by permeation of oxygen and nitrogen in the air, inhibition in leaking of the ink and generation of bubbles, a rise in the ink-discharge stability, improvement in fragrance retention in a perfume-containing ink and inferior writing brought about by reduction in an internal pressure in the vessel caused by permeation of a pressurized gas in an ink-storing vessel into the outside in a pressure type writing instrument such as a pressure type ballpoint pen pressurized by gas such as nitrogen gas; the visibility is excellent; and the remaining amount of the ink can readily be observed.

Further, an object of the present invention is to provide an ink-storing member for a writing instrument which can solve the problems of reduction in the performance quality and the life brought about by reduction in the amount of water, which is a principal solvent, caused by permeation through the ink-storing member after being turned into steam in the case of using a water-based ink and the problems of reduction in the performance and the life brought about by moisture in the air which permeates through the ink-storing member and gets into the ink in the case of using an oil-based ink.

DISCLOSURE OF THE INVENTION

Intensive research on the problems of the conventional techniques described above conducted by the present inventors have resulted in finding that an ink-storing member for a writing instrument which meets the objects described above can be obtained by providing an ink-storing member for a writing instrument which stores an ink for a writing instrument with a multilayer structure comprising a layer constituted of an organic high molecular compound and a layer constituted of an inorganic compound, and the present invention has come to be completed.

That is, the ink-storing member for a writing instrument according to the present invention comprises the following items (1) to (6).

(1) An ink-storing member for a writing instrument which stores an ink for a writing instrument, wherein the above ink-storing member for a writing instrument comprises a multilayer structure comprising an organic high molecular compound layer constituted of an organic high molecular compound and an inorganic compound layer constituted of an inorganic compound.

(2) The ink-storing member for a writing instrument as described in the above item (1), wherein the ink-storing member for a writing instrument has a parallel light transmittance of 50% or more.

(3) The ink-storing member for a writing instrument as described in the above item (1) or (2), wherein the inorganic compound layer is constituted of at least one compound selected from the group consisting of inorganic compounds of SiO, $SiO_2$, $Al_2O_3$, $CaF_2$, $SnO_2$, $CeF_3$, MgO, ZnO, $TiO_2$, $MgAlO_4$, $In_2O_3$, $SrCu_2O_2$, $CuInO_2$, $CuInSe_2$ and ITO.

(4) The ink-storing member for a writing instrument as described in any of the above items (1) to (3), wherein the ink-storing member for a writing instrument has an oxygen permeability of 10 cc/$m^2$·Day·atm or less at 25° C. and 65% RH and a steam permeability of 10 g/$m^2$·Day·atm or less at 40° C. and 90% RH.

(5) The ink-storing member for a writing instrument as described in any of the above items (1) to (4), wherein the ink-storing member for a writing instrument is obtained by sticking on a molded article comprising an organic high molecular compound, a multilayer film obtained by coating an inorganic compound layer on one face of an organic high molecular film by any one method of a deposition method, a sputtering method, an ion plating method, a plasma method and a chemical vapor deposition method and coating an adhesive layer on the other face.

(6) The ink-storing member for a writing instrument as described in any of the above items (1) to (5), wherein the ink-storing member for a writing instrument is an ink-storing vessel or an ink-storing tube for a writing instrument.

The "gas permeability" (10 cc/$m^2$·Day·atm) prescribed in the present invention (including examples described later) means a volume or a weight of gas which permeates a test piece per a unit area at a unit partial pressure difference for a unit time and means a value calculated from the following equation by measuring an amount of gas permeating a film test piece for a certain time:

gas permeability=(gas permeating amount)/[(partial pressure at high pressure side−partial pressure at low pressure side)×permeating area×time]

A factor of a thickness is not involved in the gas permeability determined by the equation described above, and it is because gas permeability itself of an ink-storing vessel and an ink-storing tube has been judged to exert an influence on the quality of the writing instrument.

BEST MODE FOR CARRYING OUT THE INVENTION

The embodiment of the present invention shall be explained below in details with reference to the drawings.

The ink-storing member for a writing instrument according to the present invention is an ink-storing member for a writing instrument which stores an ink for a writing instrument, wherein the above ink-storing member for a writing instrument comprises a multilayer structure comprising an organic high molecular compound layer constituted of an organic high molecular compound and an inorganic compound layer constituted of an inorganic compound.

Figure 1A:
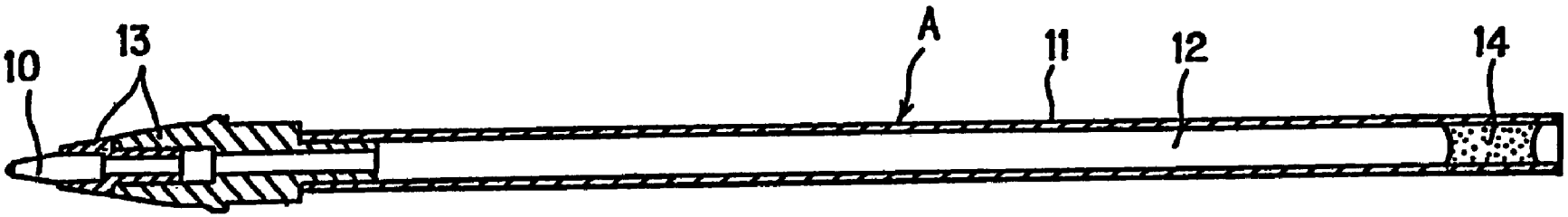
FIG. 1(*a*) is a vertical cross-sectional drawing showing a cross-section of one example in which the ink-storing member for a writing instrument according to the present invention is applied to an ink-storing tube for a ballpoint pen, and (*b*) is a partial transverse cross-sectional drawing showing an essential part thereof.
Figure 1B:
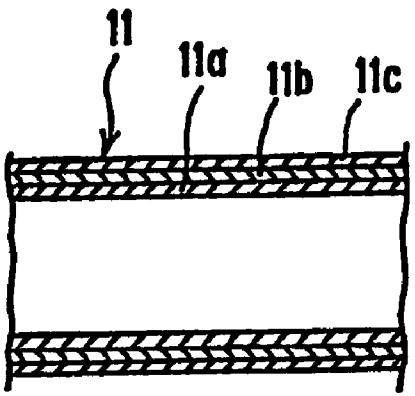
Figure 2:
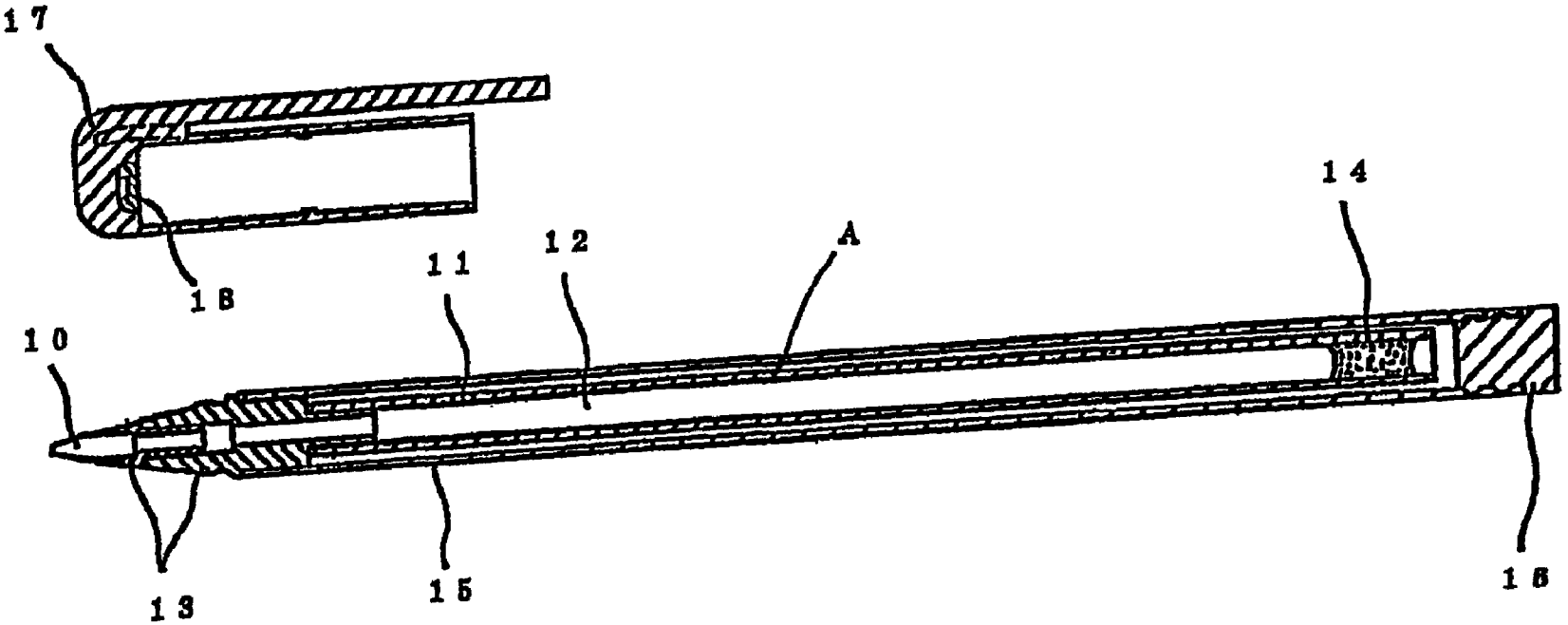
FIG. 2 is a vertical cross-sectional drawing of a ballpoint pen equipped with the ink-storing tube for a ballpoint pen shown in FIG. 1.
Figure 3:
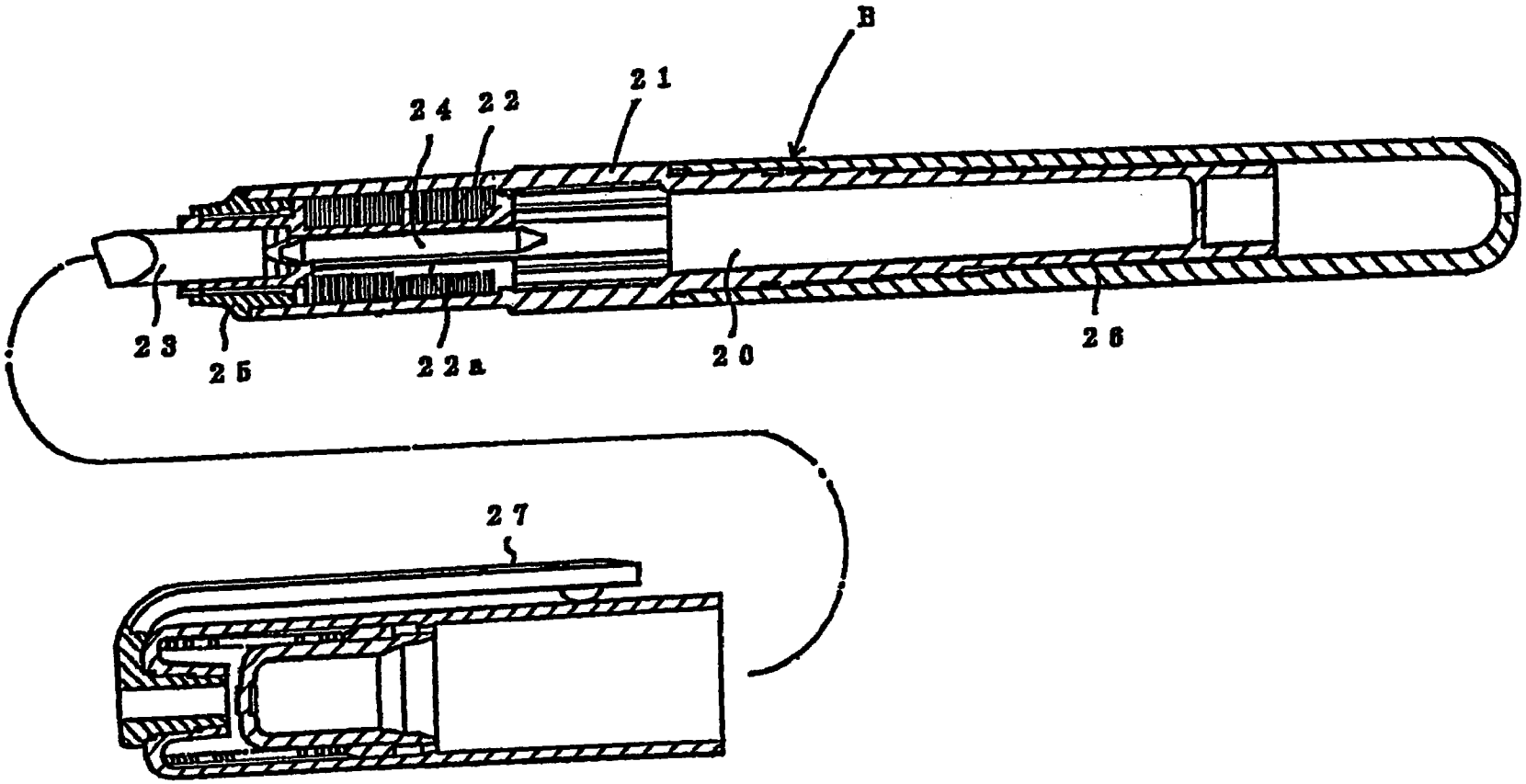
FIG. 3 is a vertical cross-sectional drawing showing one example in which the ink-storing member for a writing instrument according to the present invention is applied to a free ink type felt-tip pen.

The structure of the ink-storing member for a writing instrument according to the present invention includes, for example, the ink-storing tube (refill) in ballpoint pens shown in FIG. 1 and FIG. 2 and an ink tank part which is a barrel (ink vessel) for directly storing an ink in a free ink type writing instrument having a collector structure shown in FIG. 3. Further, it can be applied as well, though not illustrated, to an ink tank part which is a barrel (ink vessel) for directly storing an ink in a writing instrument having a valve function or an ink-storing part which stores an ink by occluding the ink in an ink occlusion body in a sliver type writing instrument, and it shall not specifically be restricted as long as it is a member for storing an ink for a writing instrument.

In the present invention, the ink-storing member for a writing instrument comprises a multilayer structure of two or more layers which comprises a layer constituted of an organic high molecular compound and a layer constituted of an inorganic compound.

In the present invention, the ink-storing member for a writing instrument comprises a multilayer structure of two or more layers, and at least one of them has to be an inorganic compound layer which is a continuous layer constituted of an inorganic compound having no pin holes, preferably an inorganic compound layer having transparency with which an ink amount and hue can be observed and having low gas permeability, particularly low oxygen permeability and low steam permeability.

Also, the embodiment of the multilayer structure of two or more layers includes, for example, a two layer structure, a three layer structure, a four layer structure and a five layer structure, and in order to further prevent permeation of gas to exert an excellent gas permeation-inhibiting effect, at least one inorganic compound layer having the gas permeability described above is preferably provided in the outermost layer in the case of the two layer structure, in an intermediate layer thereof in the case of the three layer structure and between the outermost layer and the innermost layer in the case of the four layer structure.

The inorganic compound layer having the characteristics described above in the present invention shall not specifically be restricted as long as a continuous coating layer can evenly be formed on the organic high molecular compound layer, and it includes, for example, a layer constituted of at least one selected from the group consisting of metals such as Al, Ag, Au, Pt, Cu, Mg, Fe, Ti, Su and the inorganic compound group consisting of SiO, $SiO_2$, $Al_2O_3$, $CaF_2$, $SnO_2$, $CeF_3$, MgO, ZnO, $TiO_2$, $MgAlO_4$, $In_2O_3$, $SrCu_2O_2$, $CuInO_2$, $CuInSe_2$ and ITO. However, it shall not be restricted thereto.

Preferred is the ink-storing member in which the inorganic compound coating layer is formed on the organic high molecular compound layer and in which transparency is large and an ink amount and hue can be observed, and more preferred is the ink-storing member in which the inorganic compound coating layer is formed from at least one compound selected from the inorganic compound group consisting of SiO, $SiO_2$, $Al_2O_3$, $CaF_2$, $SnO_2$, $CeF_3$, MgO, ZnO, $TiO_2$, $MgAlO_4$, $In_2O_3$, $SrCu_2O_2$, $CuInO_2$, $CuInSe_2$ and ITO which can exhibit a parallel light transmittance of 50% or more prescribed in ⌈5.5 Light Transmittance and Total Light Reflectance⌋ of JIS K7105-1981. The ink-storing member in which the inorganic compound coating layer is formed from at least one compound selected from the inorganic compound group consisting of SiO, $SiO_2$, $Al_2O_3$, $SnO_2$ and $TiO_2$ is particularly preferred from the viewpoint of exerting the effects of the present invention.

A method for forming the inorganic compound coating layer on the organic high molecular compound layer according to the present invention shall not specifically be restricted as long as it is a method by which an even and continuous layer having no pin holes can be formed.

It includes preferably a plasma film-making method making use of plasma, a chemical vapor deposition method (CVD method), a vacuum deposition method, an ion plating method in which a molecule in an evaporating source is heated and evaporated by irradiating with an electron beam to form a film and a sputtering method from the viewpoint that the workability is excellent and the inorganic compound layer can surely be tightly adhered on the organic high molecular compound layer and that an adhesion between the layers is excellent.

The compound used for the organic high molecular compound layer in the ink-storing member of the present invention shall not specifically be restricted as long as it is a resin used in an ordinary mold-processing method such as an extrusion method, a blow method and an injection method.

Preferred are polypropylene, polycarbonate, nylon, amide base resins, polymethyl methacrylate and copolymers thereof, polyethylene terephthalate, polystyrene and copolymers thereof, TPX, cyclic olefin resins, acryl-styrene copolymers, acryl-styrene-butadiene copolymers, polyvinyl chloride and copolymers thereof, polyvinylidene chloride and copolymers thereof and polyethylene and copolymers thereof which have a parallel light transmittance of 50% or more and which are highly transparent, but it shall not be restricted thereto.

A method for forming the inorganic compound layer in the ink-storing member of the present invention may be a method in which the inorganic compound layer is formed directly on a molded article which is molded and processed from the organic high molecular compound having the characteristics described above, or a method in which an adhesive layer is interposed may be used.

When directly forming the inorganic compound layer, the organic high molecular compound on which the new layer is to be formed is preferably subjected to cleaning treatment for removing stains and oil & fat and surface activating treatment such as plasma or acid treatment in order to enhance an adhesion.

The method in which an adhesive layer is interposed includes, for example, a method in which the inorganic compound layer is coated on one face of an organic high molecular film by a method such as deposition, sputtering, ion plating, a plasma method and CVD and an adhesive layer is coated on the other face to prepare a multilayer film and in which the film having the inorganic compound layer is stuck on a molded article molded and processed from an organic high molecular compound to prepare an ink-storing member comprising a multilayer structure. This method is a preferred embodiment from the viewpoints of the workability and the economical efficiency.

The foregoing film having the inorganic compound layer includes, for example, a metalline film manufactured by Tocello Co., Ltd.; VM-PET, VM-ONY and VM-CPP manufactured by Toyobo Co., Ltd. all of which have a layer of Al; a GL film manufactured by Toppan Printing Co., Ltd.; a GT film manufactured by Toyo Ink manufacturing Co., Ltd., Tech Barrier manufactured by Mitsubishi Chemical Corporation, SILAMINATE manufactured by Van Lee Co., Ltd., DOB manufactured by Galileo Co., Ltd., MOS manufactured by Oike Ind. Co., Ltd., CERAMIS manufactured by Aluswiss Co., Ltd., QLF manufactured by Airco Co., Ltd., SUPERBARRIER manufactured by PC Material Co., Ltd., all of which have a layer of SiO (or SiOx); DOB manufactured by CeTeV Co., Ltd.; TANSPACK manufactured by Flex Product Co., Ltd., both of which have a layer of $SiO_2$;

BARRIALOK 101 manufactured by Toyo Metallizing Co., Ltd. and GL-AU, GL-AE and GL-AEY manufactured by Toppan Printing Co., Ltd., all of which have a layer of $Al_2O_3$. However, it shall not be restricted thereto.

A transparency of the ink-storing member for a writing instrument according to the present invention is confirmed according to a test prescribed in [5.5 Light Transmittance and Total Light Reflectance] in JIS K 7105-1981; Testing Methods for Optical Properties of Plastics, and if the parallel light transmittance is 40% or more, a remaining amount of the ink can be observed. If it is 50% or more, a visual color of the ink itself can be observed, and therefore the ink-storing member for a writing instrument according to the present invention has preferably a parallel light transmittance of 50% or more.

In the present invention, a highly transparent resin having, as described above, a parallel light transmittance of 50% or more and at least one compound selected from the group consisting of inorganic compounds which are high in a parallel light transmittance, preferably the group consisting of inorganic compounds having a parallel light transmittance of 50% or more are suitably combined to constitute a multilayer structure, whereby obtained is the ink-storing member for a writing instrument having a parallel light transmittance of 40% or more, preferably 50% or more.

The ink-storing member for a writing instrument comprising a multilayer structure constituted of the organic high molecular compound layer and the inorganic compound layer according to the present invention has an effect of inhibiting gas permeation and can prevent deterioration in the ink and reduction in the writing quality and the life thereof. The above ink-storing member has preferably an oxygen permeability of 10 $cc/m^2$·Day·atm or less at 25° C. and 65% RH and a steam permeability of 10 $g/m^2$·Day·atm or less at 40° C. and 90% RH.

The oxygen permeability and/or the steam permeability described above can be controlled to the levels of not higher than the characteristic values described above by suitably combining the kind of the resin described above constituting the organic high molecular compound layer, the kind of the inorganic compound described above constituting the inorganic compound layer, the layer structure and the preparing method.

The permeability of gas in the ink-storing member for a writing instrument according to the present invention can be confirmed by, for example, the testing method prescribed in [7.B method (isobaric method)] of Testing Methods for Gas Permeability of Plastic film and Sheet in JIS K 7126-1987.

For example, the oxygen permeability can be determined by measuring a change in a potential difference caused when oxygen permeating a test piece is mixed in nitrogen-hydrogen gas, and it can be measured by means of an oxygen permeability-measuring apparatus OX-TRAN2 manufactured by MOCON Inc.

When this oxygen permeability is measured under the environmental condition of 25° C.-65% RH and exceeds 10 $cc/m^2$·Day·atm, oxygen permeates the ink-storing member from the outside and is intermixed into the ink-storing member for a writing instrument charged with a water-based ink, which results in causing acid deterioration in the ink, reduction in the writing performance brought about by generation of bubbles in the ink and clogging of the ink-feeding passage and shortening in a life of the writing instrument. Accordingly, the ink-storing member for a writing instrument in the present invention has preferably an oxygen permeability of 10 $cc/m^2$·Day·atm or less.

The steam permeability can be determined by measuring steam permeating a test piece by means of an infrared ray sensor, and it can be measured by means of a steam permeability-measuring apparatus PERMATRAN-W3 manufactured by MOCON Co., Ltd.

When this steam permeability is measured under the environmental condition of 40° C.-90% RH and exceeds 10 $g/m^2$·Day·atm, water, which is a principal component of the ink is turned into steam to permeate the ink-storing member for a writing instrument charged with a water-based ink, which results in bringing about deterioration such as thickening and solidification due to reduction in the amount of water in the ink itself and causing reduction in the writing performance and shortening in a life of the writing instrument. Accordingly, the ink-storing member for a writing instrument according to the present invention has preferably a steam permeability of 10 $g/m^2$·Day·atm or less.

If these oxygen permeability and steam permeability are 10 $cc/m^2$·Day·atm or less and 10 $g/m^2$·Day·atm or less respectively, desirably brought about are inhibition in reduction in the quality of an oil-based ink caused by moisture absorption and oxidation deterioration in an oil-based ink, improvement in fragrance retention in a perfume-containing ink and a rise in the writing quality and the life by maintaining a pressure of nitrogen contained in an ink-storing vessel of a pressure ballpoint pen.

The ink stored in the ink-storing member for a writing instrument according to the present invention shall not specifically be restricted as long as it is an ink usually used for a writing instrument, and stored therein is an ink for a writing instrument such as a water-based or oil-based liquid ink and a gel ink for a ballpoint pen, a pressure ballpoint pen, a felt-tip pen, a marking pen and a pen for underlines.

Next, the specific embodiment of the ink-storing member for a writing instrument according to the present invention shall be explained in further details with reference to FIG. 1 to FIG. 3.

FIG. 1(*a*), (*b*) and FIG. 2 are the case where the ink-storing member for a writing instrument according to the present invention is applied to an ink-storing tube (refill) in a ballpoint pen. The ink-storing member A for a writing instrument according to the present embodiment has an ink-storing tube 11 equipped with a ballpoint pen type tip 10, which is a pen tip, at a point thereof, wherein 12 is an ink for a ballpoint pen which is filled into the ink-storing tube; 13 is a connecting member between the pen tip and the ink-storing tube; and 14 is an ink follower.

This ink-storing tube is provided with sticking by a heat treating method, a film having a layer of an inorganic compound and a hot melt adhesive layer on a PET substrate on an external layer of a molded article obtained by molding an organic high molecular compound by extrusion molding, and as shown in FIG. 1(*b*), it comprises a multilayer structure in which formed are an organic high molecular compound layer on an innermost side 11*a*, a layer of an inorganic compound on an outermost side 11*c* and a hot melt adhesive layer in the middle of the innermost side and the outermost side.

This ink-storing member A for a writing instrument is installed, as shown in FIG. 2, in a barrel 15 for a ballpoint pen and used in the form of a ballpoint pen, wherein 16 is a plug; 17 is a cap; and 18 is a sealing rubber.

FIG. 3 is a case in which the ink-storing member for a writing instrument according to the present invention is applied to a tank part which is a barrel (ink vessel) for directly storing an ink in a free ink type writing instrument having a collector structure.

The ink-storing member B for a writing instrument according to the present embodiment is constituted of an ink tank part 21 which is a barrel for directly storing an ink 20 without absorbing the ink in a sliver.

Taken is a constitution in which an ink holder (collector member) 22 for temporarily holding the ink 20 pressed out from the ink tank part 21 when air contained in the ink tank part 21 is expanded by a rise in the temperature is housed in a front part of the ink tank part 21 in order to prevent the ink 20 from blobbing from a pen tip and a vent and in which a pen tip 23 comprising a fibrous feed is installed at a point of the collector member 22.

The ink is introduced from the ink tank part 21 to the pen tip 23 via a feeder 24 which has an ink passage 22*a* and which is housed in a central port of the collector member 22.

In FIG. 3, 25 is a holder member; 26 is a rear barrel fixed in a rear part of the ink tank part 21; and 27 is a cap. Further, the ink may be introduced by inserting a rear part of the pen tip 23 directly in the inside of the ink tank part 21 without interposing the feeder 24.

This tank part 21, which is an ink-storing tube is prepared by providing a layer of an inorganic compound on the external layer of a molded article obtained by molding an organic high molecular compound by extrusion molding, and it comprises a double layer structure in which an organic high molecular compound layer and an inorganic compound layer are formed.

It is a matter of course that the ink-storing member for a writing instrument according to the present invention shall not be restricted to the embodiments described above and can be changed to various forms as long as the gist of the present invention is not changed.

The ink-storing member for a writing instrument according to the present invention has the essential point that it is an ink-storing member for a writing instrument comprising a multilayer structure comprising an inorganic compound layer and an organic high molecular compound layer. Accordingly, when the present invention is applied to various writing instruments, structures other than that of the ink-storing member for a writing instrument described above shall not specifically be restricted, and the structures of the respective writing instruments such as a ballpoint pen, a pressure ballpoint pen, a felt-tip pen, a marking pen, a brush pen, a pen for underlines and a correction liquid are applied by installing a pen tip such as a ballpoint pen type tip, a fibrous feed, a pen feed comprising a brush feed and an applicator at the point of the ink-storing member for a writing instrument having the above structure.

A thickness (whole thickness) of the ink-storing member for a writing instrument according to the present invention varies depending on uses of the writing instrument and is preferably 0.5 to 5.0 mm, more preferably 0.5 to 3 mm, and a thickness (total thickness in the case of two or more layers) of the inorganic compound layer described above is preferably 0.01 to 20 μm, more preferably 0.01 to 16 μm from the viewpoint of the workability, the moldability and exerting more effects of the present invention.

With using the ink-storing member for a writing instrument according to the present invention which is constituted in the manner described above, that is, an ink-storing member for a writing instrument of a multilayer structure having an inorganic compound layer and an organic compound layer each comprising at least a homogeneous continuous layer, permeation of gas such as oxygen and steam can be inhibited, and a performance, a quality and a life of the writing instrument can further be improved without damaging light transmittance of an ink-storing member for a writing instrument such as an ink-storing tube (refill) in a ballpoint pen which stores an ink for a writing instrument such as a water-based or oil-based liquid ink and a gel ink, and an ink-storing vessel in a free ink type writing instrument having a collector structure which stores an ink for a writing instrument and a sliver type writing instrument.

Further, in the ink-storing member for a writing instrument according to the present invention, an amount and a hue of an ink can surely be visually observed by selecting the multilayer structure having a parallel light transmittance of 50% or more.

Further, in the ink-storing member for a writing instrument according to the present invention, an inhibition in permeability of gas, to be specific, the selection of the multilayer structure which controls the oxygen permeability to 10 $cc/m^2 \cdot Day \cdot atm$ or less under the condition of 24° C. and 65% RH makes it possible to inhibit oxygen from permeating from the outside air and therefore makes it possible to prevent the ink from being deteriorated and inhibit the ink from leaking and generating bubbles, and stability in ink discharge can be raised.

Also, the selection of the multilayer structure which controls the steam permeability to 10 $g/m^2 \cdot Day \cdot atm$ or less under the condition of 40° C. and 90% RH makes it possible to inhibit moisture from permeating from the outside to thereby inhibit the ink from being deteriorated and makes it possible to inhibit moisture contained in the ink from permeating and volatilizing to thereby improve the problems of deterioration and solidification in the ink.

Further, inferior writing brought about by reduction in an internal pressure of an ink-storing vessel in a pressure type writing instrument pressurized by gas such as a pressure ballpoint pen can be prevented, and fragrance retention in a perfume-containing ink can be enhanced.

EXAMPLES

Next, the present invention shall be explained in further details with reference to examples and comparative examples, but the present invention shall not be restricted to the following examples.

Examples 1 to 5 and Comparative Examples 1 to 2

Experimental pen bodies A-1 to A-7 which were ink-storing members for a writing instrument used in the examples and the comparative examples were prepared by the respective methods described below. Further, inks B-1 and B-2 having the following blend compositions were prepared.

Experimental Pen Body A-1: Ballpoint Pen

An ink-storing tube (refill) for a ballpoint pen was prepared by the following method. This ink-storing tube corresponds to the mark 11 shown in FIG. 1, and polypropylene was molded by an extrusion molding method to obtain a tubular molded article having a thickness of 0.7 mm, an inner diameter of 4.0 mm and a length of 120 mm.

This ink-storing member was used to assemble a refill for a ballpoint pen shown in FIG. 1 and FIG. 2.

Experimental Pen Body A-2: Ballpoint Pen

An ink-storing tube (refill) for a ballpoint pen was prepared by the following method. This ink-storing tube corresponds to the mark 11 shown in FIG. 1. Polypropylene was molded by the extrusion molding method to obtain a tubular molded article having a thickness of 0.7 mm, an inner diameter of 4.0 mm and a length of 120 mm, and a GL-AU film (multilayer composite film having an $Al_2O_3$ layer of 1 μm and a hot melt adhesive layer on a PET substrate having a thickness of 10 μm) manufactured by Toppan Printing Co., Ltd. was melt-adhered on the outside of the above molded article to obtain an ink-storing member of a multilayer structure having three layers comprising inorganic compound layer-organic high molecular compound layer-organic high molecular compound layer. This ink-storing member was used to assemble a refill for a ballpoint pen shown in FIG. 1 and FIG. 2.

Experimental Pen Body A-3: Ballpoint Pen

An ink-storing tube (refill) for a ballpoint pen was prepared by the following method. This ink-storing tube corresponds to the mark 11 shown in FIG. 1. Polypropylene was molded by the extrusion molding method to obtain a tubular molded article having a thickness of 0.7 mm, an inner diameter of 4.0 mm and a length of 120 mm, and Tech Barrier (multilayer composite film having an SiOx layer of 1.0 μm and a hot melt adhesive layer on a PET substrate having a thickness of 12 μm) manufactured by Mitsubishi Chemical Corporation was melt-adhered on the outside of the above molded article to obtain an ink-storing member of a multilayer structure having three layers comprising inorganic compound layer-organic high molecular compound layer-organic high molecular compound layer. This ink-storing member was used to assemble a refill for a ballpoint pen shown in FIG. 1 and FIG. 2.

Experimental Pen Body A-4: Ballpoint Pen

An ink-storing tube (refill) for a ballpoint pen was prepared by the following method. This ink-storing tube corresponds to the mark 11 shown in FIG. 1. Polypropylene was molded by the extrusion molding method to obtain a tubular molded article having a thickness of 0.7 mm, an inner diameter of 4.0 mm and a length of 120 mm, and an SiOx film layer having a thickness of 0.1 μm was formed on the outside of the above molded article by a plasma CVD film-making method to obtain an ink-storing member having two layers comprising inorganic compound layer-organic high molecular compound layer.

This ink-storing member was used to assemble a refill for a ballpoint pen shown in FIG. 1 and FIG. 2.

Experimental Pen Body A-5: Ballpoint Pen

An ink-storing tube (refill) for a ballpoint pen was prepared by the following method. This ink-storing tube corresponds to the mark 11 shown in FIG. 1. Polypropylene was molded by the extrusion molding method to obtain a tubular molded article having a thickness of 0.7 mm, an inner diameter of 4.0 mm and a length of 120 mm, and an Al film layer having a thickness of 0.1 μm was formed on the outside of the above molded article by the plasma CVD film-making method to obtain an ink-storing member having two layers comprising inorganic compound layer-organic high molecular compound layer.

This ink-storing member was used to assemble a refill for a ballpoint pen shown in FIG. 1 and FIG. 2.

Experimental Pen Body A-6: Free Ink Type Felt-Tip Pen

An ink-storing vessel (refill) for a ballpoint pen was prepared by the following method. This ink-storing tube corresponds to the mark 21 shown in FIG. 3, and polypropylene was molded by an injection molding method to obtain a molded article having a thickness of 0.75 mm, an inner diameter of 7.0 mm and a length of 90 mm.

This ink-storing member was used to assemble a free ink type felt-tip pen shown in FIG. 3.

Experimental Pen Body A-7: Free Ink Type Felt-Tip Pen

An ink-storing vessel (refill) for a ballpoint pen was prepared by the following method. This ink-storing tube corresponds to the mark 21 shown in FIG. 3. Polypropylene was molded by the extrusion molding method to obtain a molded article having a thickness of 0.75 mm, an inner diameter of 7.0 mm and a length of 90 mm, and an SiOx film layer having a thickness of 0.1 μm was formed on the outside of the above molded article by the plasma CVD film-making method to obtain an ink-storing member having two layers comprising inorganic compound layer-organic high molecular compound layer.

This ink-storing member was used to assemble a free ink type felt-tip pen shown in FIG. 3.

Experimental Ink B-1: Water-Based Gel Ink

The following ink ingredients were stirred and mixed so that they were evenly dispersed and dissolved to prepare a water-based gel ink for a writing instrument (whole amount: 100 parts).

A viscosity (25° C.) of this ink was measured at 1 rpm by means of an RMD type viscometer manufactured by Toki Sangyo Co., Ltd., which resulted in obtaining the value of 1420 mPa s.

| | |
|---|---|
| (Colorant) C.I. Direct Black-154 | 7.0 parts |
| (Colorant) C.I. Direct Black-19 | 2.0 parts |
| (pH controller) triethanolamine | 0.5 part |
| (Lubricant) unsaturated fatty acid potassium soap | 0.5 part |
| (Antiseptic agent) benzoisothiazoline | 0.1 part |
| (Rust preventive) benzotriazole | 0.3 part |
| (Gelatinizer) xanthan gum | 0.3 part |
| (Medium) propylene glycol | 15.0 parts |
| (Medium) purified water | balance |

Experimental Ink B-2: Water-Based Ink

The following ink ingredients were stirred and mixed so that they were evenly dispersed and dissolved to prepare a water-based ink for a writing instrument (whole amount: 100 parts).

| | |
|---|---|
| (Colorant) C.I. Direct Black-154 | 4.5 parts |
| (Colorant) C.I. Direct Black-19 | 1.5 parts |
| (pH controller) triethanolamine | 0.3 part |
| (Binder) styrene-acryl resin | 3.0 part |
| (Surfactant) Noigen P (Daiichi Kogyo Seiyaku Co., Ltd.) | 0.2 part |
| (Antiseptic agent) benzoisothiazoline | 0.1 part |
| (Medium) ethylene glycol | 10.0 parts |
| (Medium) glycerin | 10.0 parts |
| (Medium) purified water | balance |

A viscosity (25° C.) of this ink was measured at 1 rpm by means of the RMD type viscometer manufactured by Toki Sangyo Co., Ltd., which resulted in obtaining the value of 10 mPa s.

A parallel light transmittance, an oxygen permeability and a steam permeability of the experimental pen bodies A-1 to A-7 each obtained above were measured by the following methods.

A parallel light transmittance, an oxygen permeability and a steam permeability of the respective experimental pen bodies A-1 to A-7 each obtained are shown in the following Table 1.

Method for Measuring Parallel Light Transmittance:

Measured based on ⌈5.5 Light Transmittance and Total Light Reflectance⌋ in JIS K 7105-1981; Testing Methods for Optical Properties of Plastics.

Methods for Measuring Oxygen Permeability and Steam Permeability:

Based on ⌈7.B method (isobaric method)⌋ of Testing Methods for Gas Permeability of Plastic film and Sheet in JIS K 7126-1987, the oxygen permeability was measured by means of an oxygen permeability-measuring apparatus OX-TRAN2 manufactured by MOCON Co., Ltd., and the steam permeability was measured by means of a steam permeability-measuring apparatus PERMATRAN-W3 manufactured by MOCON Co., Ltd.

Example 1

The ink-storing tube of the experimental pen body A-2 described above was charged with the experimental ink B-1 to prepare a ballpoint pen using a water-based ink.

Example 2

The ink-storing tube of the experimental pen body A-3 described above was charged with the experimental ink B-1 to prepare a ballpoint pen using a water-based ink.

Example 3

The ink-storing tube of the experimental pen body A-4 described above was charged with the experimental ink B-1 to prepare a ballpoint pen using a water-based ink.

Example 4

The ink-storing tube of the experimental pen body A-5 described above was charged with the experimental ink B-1 to prepare a ballpoint pen using a water-based ink.

Example 5

The ink-storing vessel of the experimental pen body A-7 described above was charged with the experimental ink B-2 to prepare a free ink type felt-tip pen.

Comparative Example 1

The ink-storing tube of the experimental pen body A-1 described above was charged with the experimental ink B-1 to prepare a water-based ballpoint pen.

Comparative Example 2

The ink-storing vessel of the experimental pen body A-6 described above was charged with the experimental ink B-2 to prepare a free ink type water-based felt-tip pen.

A volatilization loss of the inks and a change in a viscosity of the inks stored in the ink-storing tubes of the respective pen bodies prepared in Examples 1 to 5 and Comparative Examples 1 to 2 were evaluated by the following methods, and the appearance change (presence of bubbles) with the passage of time, a leakage property of the inks and the writing performance were evaluated by the following methods.

The results thereof are shown in the following Table 2.

Evaluation of Volatilization Loss of the Inks:

The respective pen bodies were left standing under the environment of 50° C.-30% to measure the volatilization losses of the inks after 1 month and 3 months as a weight change in the pen body.

Measuring Method of Ink Viscosity:

The ink viscosity was measured at 1 rpm under the condition of 25° C. by means of an EMD type viscometer and an ELD type viscometer (manufactured by Toki Sangyo Co., Ltd.) to observe a change thereof with the passage of time (1 month and 3 months).

Evaluating Method of Appearance Change:

The pen body was preserved with the body turned downward in a capped state under the environment of 50° C.-30% to evaluate the pen body according to the following evaluation criteria after preserved for 1 month and 3 months.

Evaluation Criteria:

◎: bubbles are not observed at all to be present

○: less than five small bubbles of less than 0.1 mm are observed

Δ: five or more small bubbles of less than 0.1 mm or less than five bubbles of 0.1 mm or more are observed X: five or more bubbles of 0.1 mm or more are observed Evaluating Method of Ink-Leaking Property:

The pen body was preserved in a capped state under the environment of 50° C.-30% to evaluate the pen body according to the following evaluation criteria after preserved for 1 month and 3 months.

Evaluation Criteria:

◎: leaking of ink is not observed at all

○: leaking of ink can barely be observed with the naked eye but practically no problems Δ: leaking of ink is a little observed X: leaking of ink continuously takes place Evaluating Method of Writing Performance:

The pen body was preserved with the body turned downward in a capped state under the environment of 50° C.-30% to evaluate a writing performance of the pen body according to the following evaluation criteria after preserved for 1 month and 3 months.

Evaluation Criteria:

◎: starving is not observed at all, and drawn lines are clear and are not observed to be changed ○: starving is not observed at all, but a density of drawn lines is observed to be a little low Δ: starving is a little observed, and a density of drawn lines is reduced X: starving is frequently observed, and a density of drawn lines is considerably reduced

TABLE 1

| Ink-storing member experimental pen body | Structure | Thickness (mm) | Parallel light transmittance (%) | Oxygen permeability 10 c/m$^2$ · Day · atm | Steam permeability 10 cc/m$^2$ · Day · atm |
|---|---|---|---|---|---|
| A-1 | PP single layer | 0.70 | 85 | 2800.00 | 18.60 |
| A-2 | PP single layer + adhesive layer + $Al_2O_3$ layer | 0.712 | 84 | 3.50 | 4.00 |
| A-3 | PP single layer + adhesive layer + SiOx layer | 0.714 | 70 | 5.00 | 8.60 |
| A-4 | PP single layer + SiOx layer | 0.7001 | 80 | 5.80 | 9.50 |
| A-5 | PP single layer + Al layer | 0.7001 | 40 | 1.10 | 1.33 |
| A-6 | PP single layer | 0.75 | 85 | 2450.00 | 19.50 |
| A-7 | PP single layer + adhesive layer + SiOx layer | 0.7501 | 70 | 5.20 | 8.30 |

TABLE 2

| | | | Vaporization loss (mg) | | Ink viscosity (25° C., mPa · s) | | | Appearance change | | Ink leaking property | | Writing performance | |
|---|---|---|---|---|---|---|---|---|---|---|---|---|---|
| | Ink storing member | Ink | 1 month | 3 months | Initial | 1 month | 3 months | 1 month | 3 months | 1 month | 3 months | 1 month | 3 months |
| Example 1 | A-2 | B-1 | 11 | 29 | 1420 | 1500 | 1530 | ◎ | ◎ | ◎ | ◎ | ◎ | ◎ |
| Example 2 | A-3 | B-1 | 18 | 55 | 1420 | 1510 | 1610 | ◎ | ◎ | ◎ | ◎ | ◎ | ◎ |
| Example 3 | A-4 | B-1 | 17 | 52 | 1420 | 1510 | 1590 | ◎ | ◎ | ◎ | ◎ | ◎ | ◎ |
| Example 4 | A-5 | B-1 | 9 | 27 | 1420 | 1480 | 1520 | ◎ | ◎ | ◎ | ◎ | ◎ | ◎ |
| Example 5 | A-7 | B-2 | 31 | 94 | 10 | 14 | 27 | ◎ | ◎ | ◎ | ◎ | ◎ | ◎ |
| Comparative Example 1 | A-1 | B-1 | 36 | 103 | 1420 | 2010 | 3800 | X | X | ○ | Δ | ○ | Δ |
| Comparative Example 2 | A-6 | B-2 | 18 | 52 | 10 | 11 | 14 | X | X | Δ | X | Δ | X |

As apparent from the results shown in Table 1 and Table 2, it has become clear that permeation of gas such as oxygen and steam can be inhibited in the ink-storing members for a writing instrument having a multilayer structure constituted of an inorganic compound layer and an organic high molecular compound layer prepared in Examples 1 to 5 falling in the scope of the present invention as compared with those prepared in Comparative Examples 1 to 2 falling outside the scope of the present invention, whereby deterioration in the ink itself, reduction in the writing performance caused by generation of bubbles and leaking of the ink and reduction in the life can be inhibited.

It has become clear that the ink-storing members for a writing instrument prepared in Comparative Examples 1 to 2 comprise an organic compound layer (PP single layer) and therefore can not inhibit deterioration in the ink itself and prevent generation of bubbles in the ink and that reduction in the writing performance caused by leaking of the ink and reduction in the life are brought about.

INDUSTRIAL APPLICABILITY

According to the present invention, provided is an ink-storing member for a writing instrument which can inhibit permeation of gas such as oxygen and steam, deterioration in the ink itself, reduction in the writing performance caused by generation of bubbles and leaking of the ink and reduction in the life.

Further, provided is an excellent ink-storing member for a writing instrument in which an ink amount and a hue of an ink can be observed from the outside by maintaining a parallel light transmittance of this ink-storing member itself having a multilayer structure at 50% or more.

The invention claimed is:

1. An ink-storing member for a writing instrument, the ink-storing member stores an ink for the writing instrument, wherein the ink-storing member comprises a multilayer structure comprising an organic high molecular compound layer constituted of an organic high molecular compound and an inorganic compound layer constituted of an inorganic compound layer, the ink-storing member having a parallel light transmittance of 50% or more, wherein the inorganic compound layer is comprised of inorganic compounds selected from the group consisting of SiO, $SiO_2$, $Al_2O_3$, $CaF_2$, $SnO_2$, $CeF_3$, MgO, ZnO, $TiO_2$, $MgAlO_4$, $In_2O_3$, $SrCu_2O_2$, $CuInSe_2$, $CuInSe_2$ and ITO.

2. The ink-storing member for a writing instrument as described in claim 1, wherein the ink-storing member for a writing instrument has an oxygen permeability of 10 cc/m$^2$·Day·atm or less at 24° C. and 65% RH and a steam permeability of 10 g/m$^2$·Day·atm or less at 40° C. and 90% RH.

3. The ink-storing member for a writing instrument as described in claim 2, wherein the ink-storing member for a writing instrument is an ink-storing vessel or an ink-storing tube for a writing instrument.

4. The ink-storing member as described in claim 1, wherein the ink-storing member for a writing instrument comprises a molded article comprising an organic high molecular compound, a multilayer film, an inorganic compound layer, and an organic high molecular film, the multilayer film comprising the inorganic compound layer coated on one face of the organic high molecular film by any one method of a deposition method, a sputtering method, an ion plating method, a plasma method and a chemical vapor deposition method and coating an adhesive layer on the other face.

5. The ink-storing member for a writing instrument as described in claim 4, wherein the ink-storing member for a writing instrument is an ink-storing vessel or an ink-storing tube for a writing instrument.

6. The ink-storing member for a writing instrument as described in claim 1, wherein the ink-storing member for a writing instrument is an ink-storing vessel or an ink-storing tube for a writing instrument.

* * * * *